US006568570B1

(12) United States Patent
Amberg et al.

(10) Patent No.: US 6,568,570 B1
(45) Date of Patent: May 27, 2003

(54) PACKAGING FOR A PASTE PRODUCT

(75) Inventors: Guenther Amberg, Neuss (DE); Bernd Schenk, Waldbronn (DE)

(73) Assignee: Ecolab GmbH & Co. OHG, Dusseldorf (DE)

( * ) Notice: Subject to any disclaimer, the term of this patent is extended or adjusted under 35 U.S.C. 154(b) by 0 days.

(21) Appl. No.: 09/508,338

(22) PCT Filed: Aug. 29, 1998

(86) PCT No.: PCT/EP98/05482

§ 371 (c)(1),
(2), (4) Date: Jul. 12, 2000

(87) PCT Pub. No.: WO99/12816

PCT Pub. Date: Mar. 18, 1999

(30) Foreign Application Priority Data

Sep. 9, 1997 (DE) ..... 197 39 333

(51) Int. Cl.[7] ..... B67D 5/42

(52) U.S. Cl. ..... 222/386.5; 222/95; 222/207; 222/325

(58) Field of Search ..... 222/95, 107, 206, 222/215, 325, 207, 209, 212, 214, 386.5

(56) References Cited

U.S. PATENT DOCUMENTS 3,945,539 A * 3/1976 Sossong ..... 222/95
4,153,185 A * 5/1979 Nilson ..... 222/212
4,889,644 A 12/1989 Amberg et al. ..... 252/8.9
5,090,963 A * 2/1992 Gross et al. ..... 604/132
5,312,018 A * 5/1994 Evezich ..... 222/95
5,348,173 A * 9/1994 Norwood ..... 215/10
5,398,851 A * 3/1995 Sancoff et al. ..... 222/386.5
6,149,034 A * 11/2000 Amberg et al. ..... 222/82
6,206,242 B1 * 3/2001 Amberg et al. ..... 222/1

FOREIGN PATENT DOCUMENTS

| | | |
|---|---|---|
| DE | 195 00 006 | 7/1996 |
| EP | 0 295 525 | 12/1988 |
| FR | 2 581 562 | 11/1986 |
| WO | WO94/15846 | 7/1994 |
| WO | WO 98/15683 | 4/1998 |

* cited by examiner

*Primary Examiner*—Gene Mancene
*Assistant Examiner*—M A Cartagena
(74) *Attorney, Agent, or Firm*—Andrew D. Sorensen

(57) ABSTRACT

Packaging for a paste product is provided in the form of a flexible, closed storage container which has a sealable outlet opening on the underside. The opening is adapted for connection to a metering device which conveys the product using negative pressure, permitting substantially complete emptying of the container. To this end, the flexible storage container is configured with a thinner wall in its upper section than in its lower section.

21 Claims, 2 Drawing Sheets

PACKAGING FOR A PASTE PRODUCT

BACKGROUND 1.0 Field of the Invention

This invention relates generally to packaging for a paste-form product, and more specifically to such packaging in the form of a closed storage container with a closable outlet opening on its bottom portion designed to be coupled to a dosing unit.

2.0 Discussion of Related Art

Liquid to paste-form detergents are known. These detergents are generally adapted to meet household requirements which means that they have to be sufficiently liquid so that they can be poured out and dosed without difficulty. Since, in addition, they have to be stable in storage over a relatively broad temperature range, the use of organic solvents and/or hydrotropic additives normally cannot be avoided. Unfortunately, such additives are non-detersive, relatively expensive and take up additional packaging volume and transportation and storage capacity. In addition, the presence of flammable solvents is particularly problematic in that it necessitates additional safety precautions on account of the comparatively high consumption of detergents in laundries. For this reason, detergent concentrates of this type are of only limited use, if any, for laundries.

Accordingly, powder-form detergents is labor-intensive, particularly in large extensively automated laundries, the detergents are generally stored and dosed in predissolved form as stock liquors, i.e. a water-containing concentrate is first prepared and then delivered to the individual washing stations. However, the detergents traditionally used in laundries contain relatively high percentages of washing alkalis which are poorly soluble in cold water and, in addition, lead to "salting out" effects. They cause phase separation with the result that the organic components, more especially the nonionic surfactants and soaps, separate and cream up. Accordingly, the stock liquors have to be diluted relatively heavily with water and, in addition, intensively stirred and circulated in a continuous cycle to prevent individual components from being deposited in the feed lines to be washing stations. Consequently, such processes involve high capital outlay on large mixing tanks and the associated mixing and feed systems, and require a constant supply of energy for heating and circulating the stock liquors.

A detergent which meets these requirements is described in EP 0 295 525. This detergent is a paste-form detergent which imposes particular demands on handling for dosing and mixing with water as the solvent. Such detergent pastes are transported and stored in large containers. It is proposed that the storage container be placed in a removal unit above the dosing unit and that the paste be removed downwards. Where a pack of the type in question with a flexible storage container is used, it is proposed that a follower plate be placed on the flexible storage container accommodated in the outer container, this follower plate exerting pressure on the storage container to obtain largely complete emptying of the storage container.

It has been found that the follower plate has to be made very heavy if uniform lowering and substantially complete emptying of the storage container are to be obtained. However, this has the disadvantage that such heavy weights are very difficult to handle which increases the risk of errors in operation. In addition, the heavy follower plate necessitates an overall very stable and hence expensive construction for accommodating the pack.

Accordingly, with the problems of the related art in mind, the problem addressed by the present invention is to further develop packaging for paste-form products in such a way that the storage container can be safely and substantially completely emptied by simple means.

According to the invention, the solution to this problem is to improve prior packaging by making of the flexible storage container thinner in its upper part than in its lower part.

Through use of the aforesaid embodiment of the invention, the subject pack or packaging or storage container can be emptied substantially completely without significant effort by simple means and without any need for aids in the form of a heavy follower plate. This is because, through the removal of product by reduced pressure, the thinner-walled region follows the product towards the outlet opening and adheres or moves closely to the thicker-walled region so that the paste-form product is largely stripped off, thereby providing a function similar to that of a follower plate in a cartridge.

In a preferred embodiment of the invention, the flexible storage container consists of a lower part with relatively thick walls and an upper part with relatively thin walls which are joined closely together. In this way, the pack is easy to make and, for example, by welding together the two bag-like portions differing in their wall thickness.

In order to optimize the emptying process, the upper and lower parts preferable have substantially the same volume. Another volume ratio may also be selected, depending on the product.

In the interests of optimal complete emptying, it is preferred that the walls of the upper part be about three times thinner than those of the lower part, the walls of the lower part being about 0.6 mm thick and consisting of polyethylene or polyethylene blends. The wall thickness can assume other values.

BRIEF DESCRIPTION OF THE DRAWINGS

The invention is described in more detail in the following with reference to the accompanying drawing, in which like items are identified by the same reference designation, wherein.

DETAILED DESCRIPTION OF THE INVENTION

Figure 1:
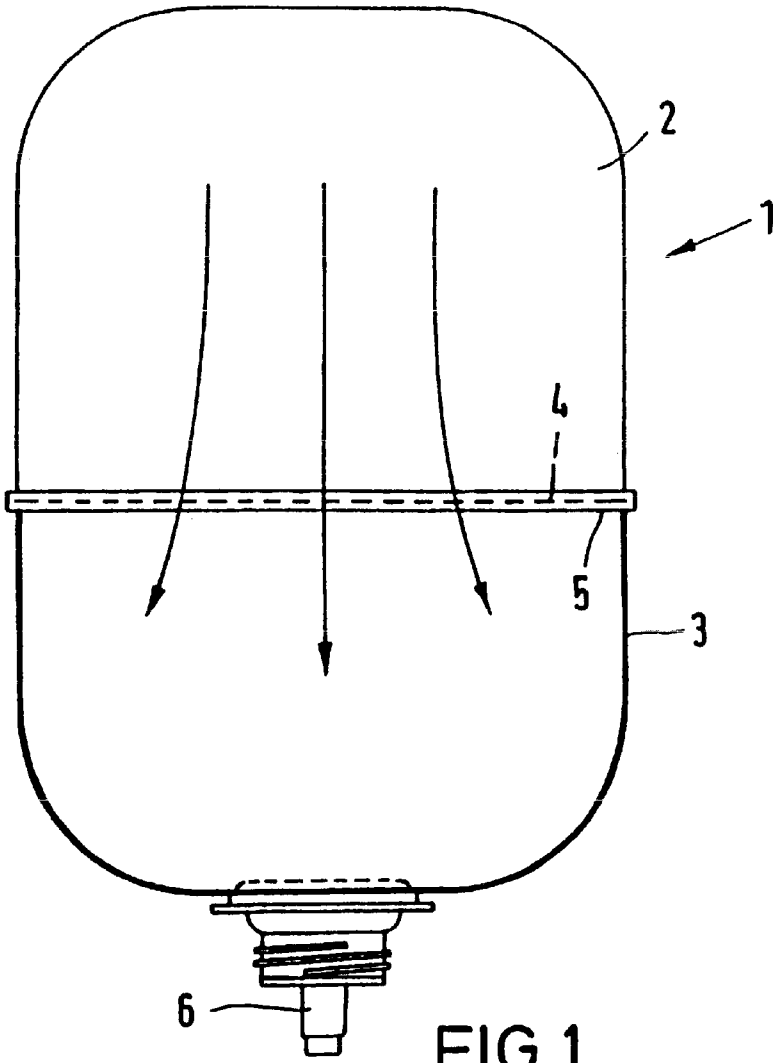
FIG. 1 is a side elevation of a full pack according to the invention.

In FIG. 1, a according to the invention for a paste-form product consists of a flexible pack or storage container 1 which, in the embodiment illustrated, consists of two bag-like parts, namely an upper part 2 and a lower part 3. The two parts 2 and 3 preferably consist of a plastic film, the walls of the upper part 2 being thinner than the walls of the lower part 3. For example, the upper part 2 has a wall thickness of 0.2 mm while the wall thickness of the lower part is about three times greater, i.e. 0.6 mm. To form the storage container 1, the two parts 2,3 are welded together in abutting relationship, the weld seam being denoted by the reference numeral 4. At the same time, a supporting ring 5 may be included in the weld.

On its bottom surface, the storage container 1 has a centrally located closable port-like outlet opening 6 in the form of an adapter, for example, which enables the storage container to be connected to a dosing unit described hereinafter. The upper part 2 and the lower part 3 have substantially the same volume although other volume ratios can also be selected according to the product.

Figure 2:
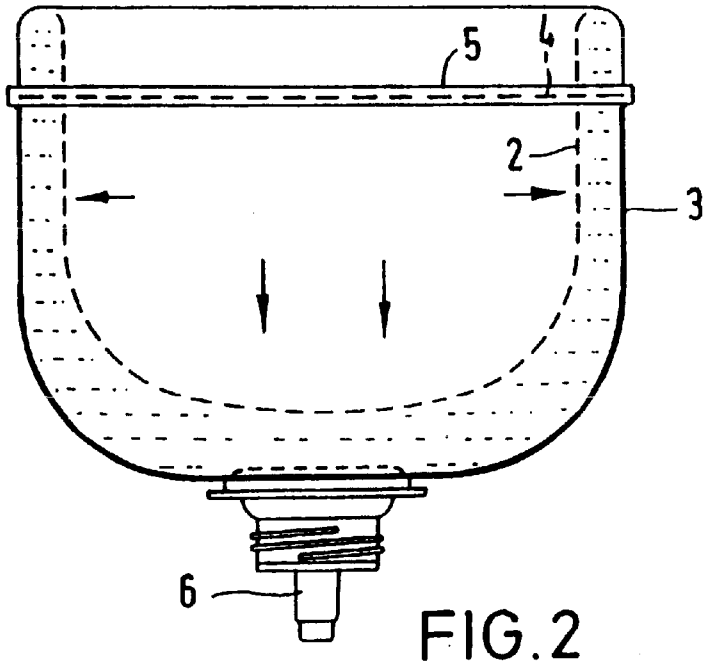
FIG. 2 shows the pack illustrated in FIG. 1 after substantially complete emptying.

If, the paste-form product is removed from the outlet opening 6 by reduced pressure, the upper thinner part 2 follows the emptying storage container 1 towards the outlet opening 6 and or adheres itself to the walls of the lower thicker part 3, as shown in FIG. 2. The upper thinner part 2 strips off most of the paste-form product, similar to the function of a follower plate in a cartridge, and provides for effective emptying of the storage container 1 without any need for additional aids, such as a follower plate.

Figure 3:
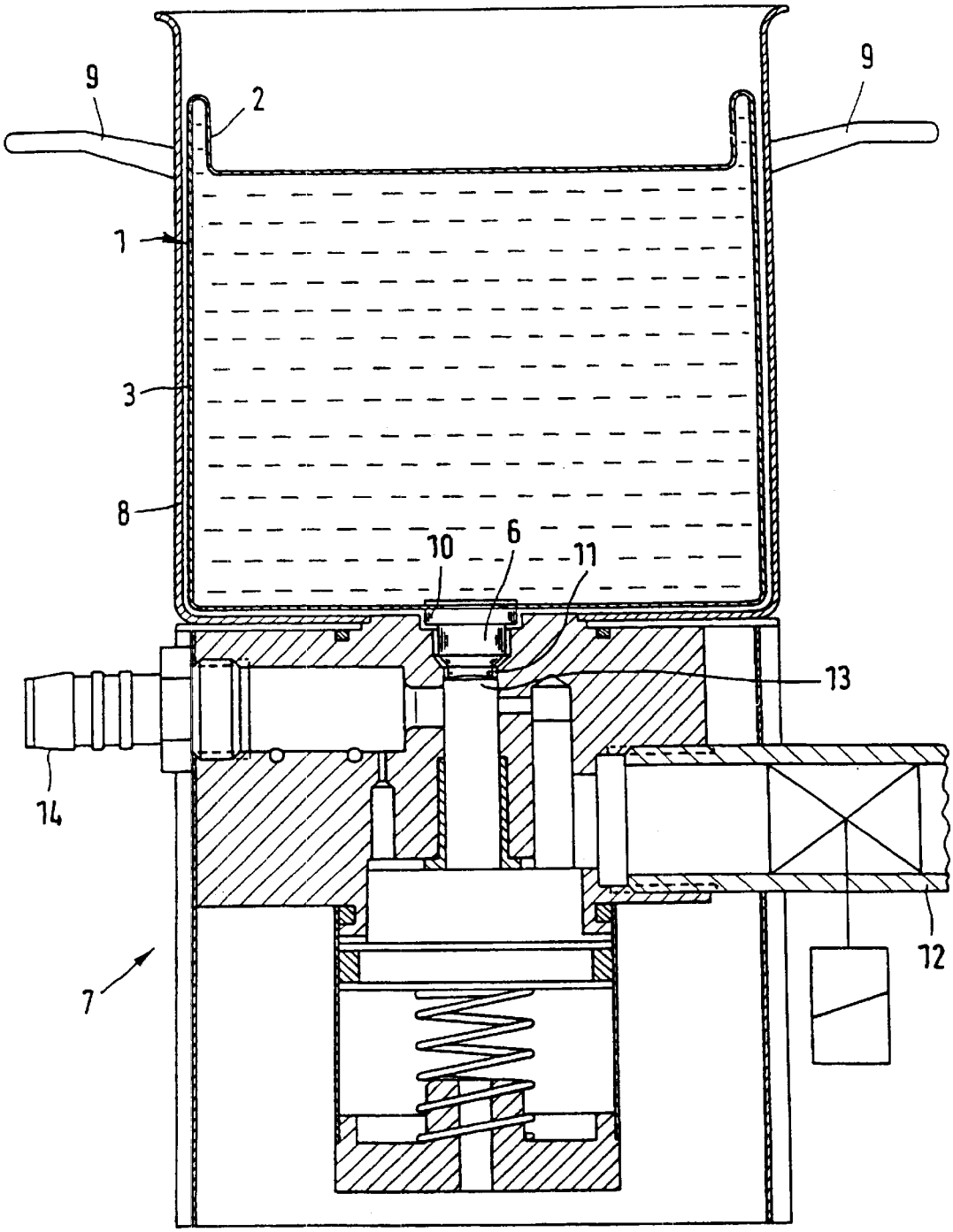
FIG. 3 shows a partial cross sectional view of a pack placed in a dosing unit.

As shown in FIG. 3, a storage container of the embodiment described above is designed to be accommodated in a dosing unit generally denoted by the reference numeral 7. This dosing unit 7 comprises a frame on which is placed a dimensionally stable container 8 optionally equipped with handles 9. The container 8 is designed to accommodate a pack or storage container 1 according to the invention. The bottom of the container 8 is provided with a central opening 10 through which the adapter-like outlet opening 6 of the storage container 1 projects into an input port of the dosing unit 7 where it is designed to be closely coupled with the opening or entrance 11 of the input part of the dosing unit 7. The construction of the dosing unit 7 is well-known in the art and need not be described any further here. In addition to the paste-form product from the storage container 1, water is fed to the dosing unit 7 through the inlet 12. Under the effect of the reduced pressure developed in the region 13, the water is mixed with the paste-form product and issues from the dosing unit 7 through the outlet 14 in the desired dosing ratio.

The invention is not of course confined to the illustrated embodiments. Further modifications may be recognized by those of skill in the art without departing from the basic concept. Thus, other dimensions can be selected for the storage container 1 according to the particular paste-form product. A differently designed dosing unit can also be used, etc. Such modifications are meant to be covered by the spirit and scope of the appended claims.

What is claimed is:

1. A dosing apparatus for dispensing a paste-form product, comprising a dosing unit and a bag-like storage container;

the dosing unit comprising:

a dimensionally stable container;

the dimensionally stable container supporting the storage container;

an input port;

the input port for receiving the product from the storage container supported by the storage container; and a mechanism comprising a pressure reduction apparatus and a mechanism outlet;

the mechanism being coupled to the input port below the dimensionally stable container;

the pressure reduction apparatus providing reduced pressure for drawing product under suction from the storage container and through the mechanism outlet;

the bag-like storage container being formed from flexible material and comprising an outlet port, a lower portion, and an upper portion;

the lower portion comprising concave walls;

the outlet port being located on a bottom of the lower portion;

the upper portion having flexible, continuously pliable bag-like walls;

the upper portion walls being thinner than the lower portion walls;

the upper portion opening into the lower portion;

wherein the effect of the pressure reduction apparatus urges the walls of the upper portion toward the walls of the lower portion and, through interior reduced pressure, the upper portion walls follow the level of product as it is withdrawn under suction toward the outlet port.

2. The dosing device of claim 1, wherein the lower and upper portions of the flexible storage container are bonded together.

3. The dosing device of claim 1, wherein the lower and upper portions of the flexible storage container are welded together.

4. The dosing device of claim 2, wherein the lower and upper portions have substantially the same volume.

5. The dosing device of claim 1, wherein the lower and upper portions have substantially the same volume.

6. The dosing device of claim 5, wherein the lower and upper portions of the flexible storage container are bonded together.

7. The dosing device of claim 1, wherein the upper portion has walls that are three times thinner than the walls of the lower portion.

8. The dosing device of claim 7, wherein the lower and upper portions of the flexible storage container are bonded together.

9. The dosing device of claim 8, wherein the wall thickness of the lower portion is 0.6 mm.

10. The dosing device of claim 7, wherein the wall thickness of the lower portion is 0.6 mm.

11. A bag-like storage container for paste-form products, comprising:

a first section comprising a concave wall and a peripheral edge;

an outlet port;

the outlet port being secured to the bottom of the first section; and a second section comprising a wall and a peripheral edge;

the second section being constructed of flexible, continuously pliable material;

the second section wall being thinner than the first section wall;

the second section opening into the first section; and the first and second section being coupled in sealing engagement along the peripheral edges therebetween;

wherein when the storage container is supported by a dimensionally stable container, applying storage pressure to the outlet port pulls paste-form product from the container, urging the second section wall toward the first section wall and through internal suction pressure, the wall of the second section passively follows the level of the product left within the container, as the product is withdrawn therefrom.

12. The storage container of claim 11, wherein the first and second sections are bonded together.

13. The storage container of claim 12, wherein the first and second sections have substantially the same volume.

14. The storage container of claim 11, wherein the first and second sections are welded together.

15. The storage container of claim 14, wherein the first and second sections have substantially the same volume.

16. The storage container of claim 11, wherein the first and second sections have substantially the same volume.

17. The storage container of claim 11, wherein the second section has walls three times thinner than those of the first section.

18. The storage container of claim 17, wherein the wall thickness of the first section is 0.6 mm.

19. The storage container of claim 17, wherein the first and second sections consist of plastic film material.

20. The storage container of claim 19, wherein the wall thickness of the first section is 0.6 mm.

21. The storage container of claim 11, wherein the first and second sections consist of plastic film material.

* * * * *